US005466933A

United States Patent [19]

Bryson, III et al.

[11] Patent Number: 5,466,933

[45] Date of Patent: Nov. 14, 1995

[54] DUAL ELECTRON ANALYZER

[75] Inventors: Charles E. Bryson, III, Santa Clara; Michael A. Kelly, Portola Valley, both of Calif.

[73] Assignee: Surface Interface, Inc., Mountain View, Calif.

[21] Appl. No.: 287,103

[22] Filed: Aug. 8, 1994

Related U.S. Application Data

[63] Continuation of Ser. No. 980,390, Nov. 23, 1992, abandoned.

[51] Int. Cl.[6] ..... H01J 49/48

[52] U.S. Cl. ..... 250/305; 250/294; 250/296; 250/298

[58] Field of Search ..... 250/305, 294, 250/296, 298, 293, 291, 290

[56] References Cited

U.S. PATENT DOCUMENTS

| | | | |
|---|---|---|---|
| 3,138,706 | 6/1964 | Brown et al. | 250/305 |
| 3,916,188 | 10/1975 | Devienne | 250/294 |
| 4,412,131 | 10/1983 | Froitzheim | 250/294 |
| 4,845,361 | 7/1989 | Ibach et al. | 250/305 |
| 5,013,923 | 5/1991 | Litherland et al. | 250/294 |
| 5,126,565 | 6/1992 | Rose | 250/305 |
| 5,153,433 | 10/1992 | Andresen et al. | 250/296 |

*Primary Examiner*—Jack I. Berman
*Assistant Examiner*—Kiet T. Nguyen
*Attorney, Agent, or Firm*—James E. Eakin; Janet Kaiser Castaneda

[57] ABSTRACT

An electron energy analyzer uses identical sectors, typically though not necessarily ninety degree segments of a toroid, disposed in complementary relationship with an aperture therebetween to provide a mapping of the image at the entrance plane to the exit plane while permitting the desired energy analysis to be performed.

13 Claims, 3 Drawing Sheets

DUAL ELECTRON ANALYZER

This application is a continuation of application Ser. No. 07/980,390, filed Nov. 23, 1992, now abandoned.

FIELD OF THE INVENTION

This invention relates generally to electron energy analyzers; and, specifically to an electrostatic electron analyzer with a dispersive sector and a complementary sector enabling selective energy focusing for use in analytical instrumentation and imaging diffraction systems, such as electron spectroscopy.

BACKGROUND OF THE INVENTION

Electron energy analyzers are well known in the art. Such devices are used to analyze a beam of electrons having differing kinetic energies to provide information about the composition of materials from which the electrons were emitted, since different elements emit electrons with characteristic kinetic energies. In addition to spectral information, some electron energy analyzers also preserve information about the spatial distribution of the electrons in the incident beam, so that in addition to spectral information it is possible to determine where in the sample a particular element is located.

The illuminating source of electrons is generally a spatially dispersed, roughly parallel beam of electrons which are focused to an entrance aperture or slit of the analyzer, which defines the initial position of the electrons. The beam of electrons are then subjected to electric or magnetic fields, generally perpendicular to the incident beam, which cause electrons of differing kinetic energies to follow different trajectories. The fields in the analyzer cause all electrons of a given kinetic energy to be re-focused on an exit plane, hence causing the electrons to be spatially dispersed according to their kinetic energy. By placing an exit slit at an appropriate location in this plane it is possible to select electrons of a specific energy to exit, either for detection or further processing.

A common analyzer which has been widely used is a hemispherical analyzer, or spherical capacitor analyzer (SCA). In an SCA, the entrance and exit apertures are in the same plane, and the electrons follow orbits which are approximately 180° segments of circles. By placing appropriate lenses before and after these two apertures, it is possible to reconstruct the initial spatial distribution of the electrons to provide spatial information about the energy of the analyzed electrons. In this way it is possible, for example, to determine where in a material being analyzed a particular element is located.

There are several problems with current electron analyzers which provide both spatial and spectral information. One problem is that the lenses placed before and after the hemispherical analyzer distort the image so that small features cannot be resolved. Also, the hemispherical analyzer has internal aberrations which degrade image quality. In addition, the combined system has very low throughput—that is, many of the incident electrons are lost and are not present in the final image, so that the sensitivity of the analysis is very low. It is very difficult to trade off spectral resolution for image quality.

As a result, a heretofore unsolved need exists for an electron energy analyzer that enables the user to selectively focus electrons without dispersion and with decreased spherical aberrations.

SUMMARY OF THE INVENTION WITH OBJECTS

An electron analyzer system is provided having a dispersion sector and a complementary, opposed sector, an electrical feedthrough, and a linear motion feedthrough enabling open aperture conditions or selectable aperture sizes. The sectors are preferably 90 degree spherical sectors, however, other shapes may be used in at least some embodiments. The system generally is housed in an enclosure with magnetic shielding.

In operation, a conventionally focused electron beam is introduced perpendicular to the entry plane of the first, dispersive sector, thereby producing a beam focused at the exit plane of the first sector. An aperture is disposed between the two 90 degree sectors for band pass selection into the complementary sector. The provision of the complementary sector cancels dispersion of the beam produced in the first sector and reduces certain spherical aberrations.

As the result of the complementary sectors, and the resultant cancellation of unwanted dispersive effects, a one to one mapping of the inlet and exit planes can be provided, thus ensuring improved images, and in many cases preserving the image while at the same time permitting the desired analysis to be performed.

A general object of the present invention is to provide an electron analyzer that overcomes the drawbacks and limitations of the prior art.

A specific object of the present invention is to provide an electron analyzer system having a dispersive sector and a complementary sector.

One more specific object of the present invention is to provide an electron analyzer with dual, opposed, 90 degree spherical sectors, the dual sectors enabling cancellation of the dispersion produced in the first sector by the second sector, the cancellation producing an exit image substantially identical to the entrance image.

Another specific object of the present invention is to provide a dual sector electron analyzer system having variable apertures for selecting a desired energy bandwidth.

A further object of the present invention is to provide an electron beam analyzer which provides a one to one mapping between the entry and the exit planes.

Still one more specific object of the present invention is to provide a dual sector electron analyzer system suitable for use in analytical instrumentation such as X-Ray photoelectron spectroscopy (XPS), imaging apparatus, reflective high energy electron diffraction (RHEED), auger electron spectroscopy (AES), microscopes, and imaging diffraction systems.

These and other objects, aspects, advantages and features of the present invention will be more fully understood and appreciated upon consideration of the following detailed description of a preferred embodiment, taken in conjunction with the accompanying drawings.

DETAILED DESCRIPTION OF A PREFERRED EMBODIMENT

Figure 1:
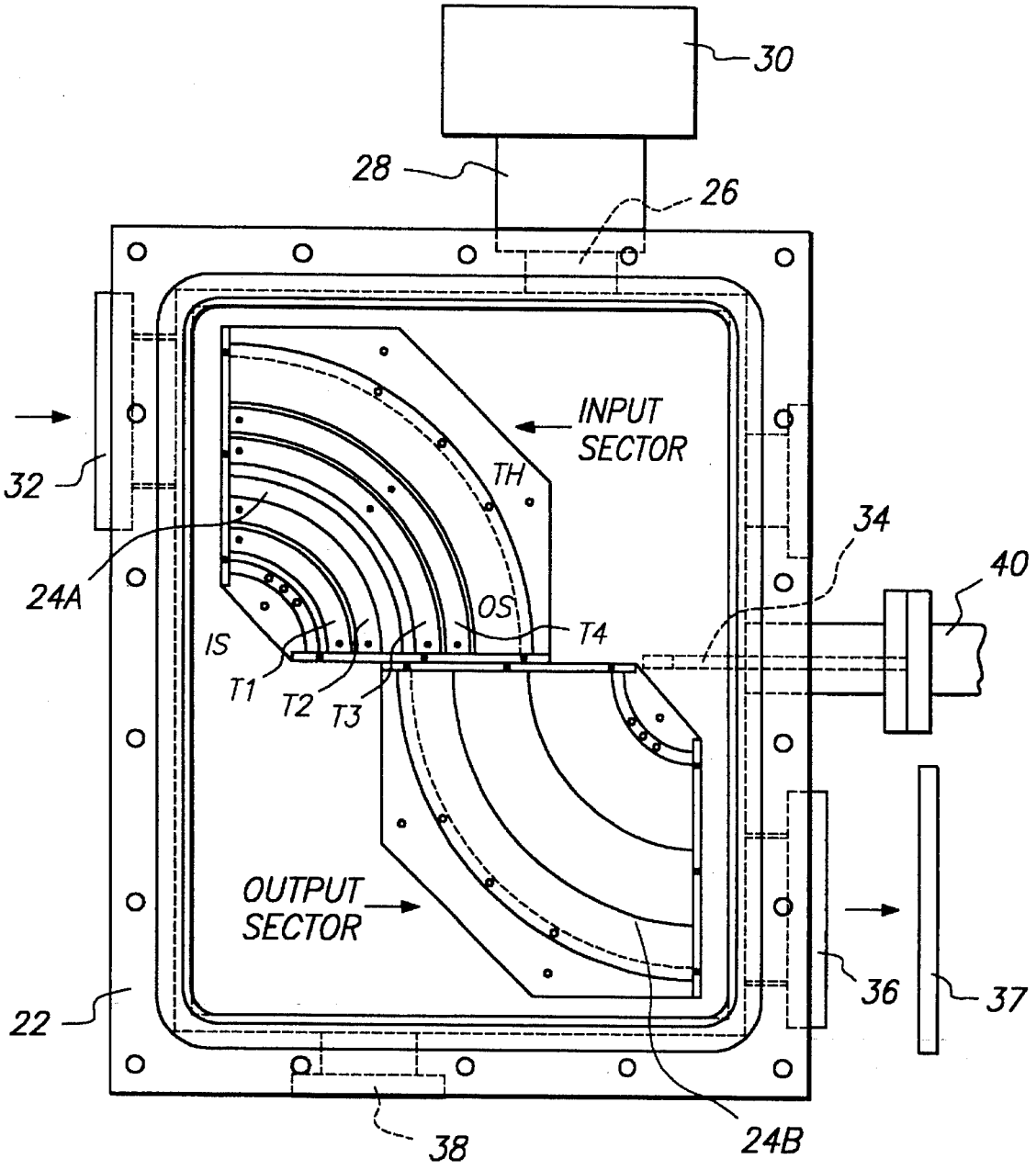
FIG. 1 is a top plan view of the present invention shown in use in an ultra-high vacuum enclosure for electron spectroscopy, wherein the top of the enclosure has been removed.
Figure 2:
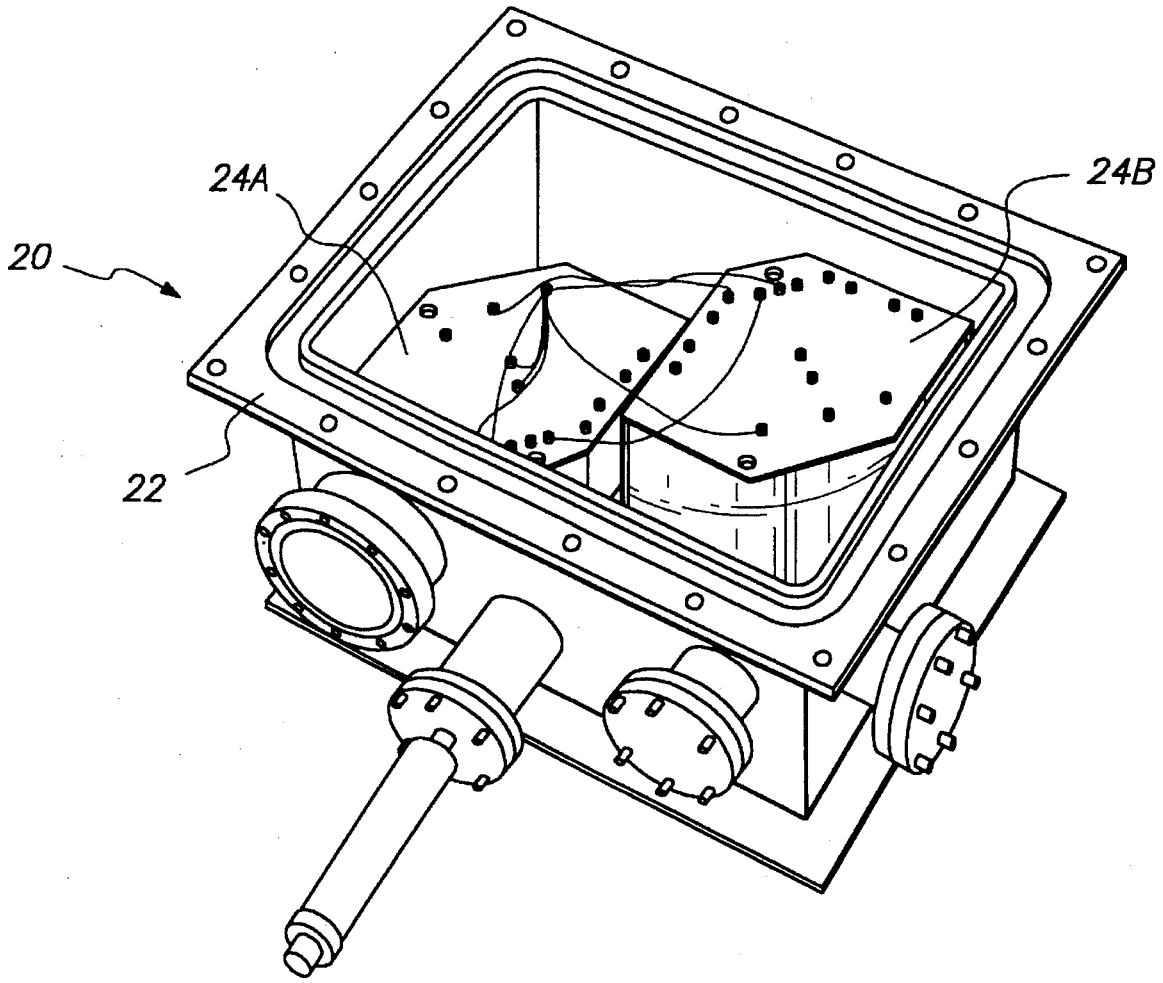
FIG. 2 is a top right perspective view of the embodiment shown in FIG. 1.

Referring first to FIGS. 1 and 2, an electrostatic electron analyzer 20 embodying the present invention is shown in top plan view with the top cover removed. The analyzer 20, which is typically operated in an ultra-high vacuum environment for electron spectroscopy and related tasks, includes an outer housing 22 for use in an ultra-high vacuum environment. The housing 22 is typically constructed of stainless steel, for example, or other material suitable for use in a high-vacuum environment, A complementary, opposing pair of 90° sectors 24A and 24B are disposed within the housing 22 to form, in essence, an S shape with an aperture therebetween.

A valve inlet 26 is provided at the top of the chamber 22 as shown in FIG. 1 for connection of a valve 28 and vacuum pump 30 thereto, to permit the evacuation of the chamber 22 as appropriate.

An inlet 32 in the housing 22 communicates with an opening in the sector 24A, and enables introduction of a conventionally collimated electron beam. The beam passes through the housing and is curved by the applied field. The applied field in the sector curves the trajectories of the electrons such that, regardless of their position in the collimated beam, all electrons having a particular energy are focused at a point, or in a line, on the aperture plate. Higher energy electrons follow a path with less curvature, while electrons having a lower energy level follow a path with higher curvature, thereby spatially dispersing all of the electrons in the incident beam on the aperture plate according to energy.

The beam then passes through an aperture 34 between the sectors 24A and 24B, and enters the opposing sector 24B. The aperture 34 selects electrons of a specific energy or range of energies. As before, higher energy electrons take a path of lower curvature, while lower energy electrons take a path of higher curvature. The beam then exits the sector 24B at the exit plane, where it passes through an exit orifice or outlet 36. A detector will typically be placed near the outlet 36; a typical detector 37 will be a microchannel plate detector or other suitable device such as a two dimensional imaging detector. The aperture 34, which essentially comprises a slit, may be thought of as a band pass filter in combination with sphere sets.

An electrical feedthrough port 38 is provided for connection to a conventional high voltage source. The electrical feedthrough may be a standard 8 pin connector, for example.

A high vacuum port 40 is provided in the housing 22, through which an aperture 34 may be selectively positioned between the sectors 24A–B within the chamber 22.

It will therefore be appreciated that the opposing sectors 24A–B provide a path by which the incoming, nominally collimated beam may be mapped from the entrance to the exit thereby preserving the image of the incident electron beam. The incoming beam may be of any conventional shape, with square and circular cross-sections being typical although not exclusive. Because the electron beam is collimated sufficiently, the present invention permits energy analysis to be performed while preserving the image. While the sectors 24A–B are, in the embodiment described, shown as 90 degree sectors, other angles are acceptable, such as 66⅔ degrees, so long as the complementary nature of the sectors is preserved and the focusing property of the sphere set is such that the collimated beams focus at the aperture is in at least the dispersion directions.

Figure 3:
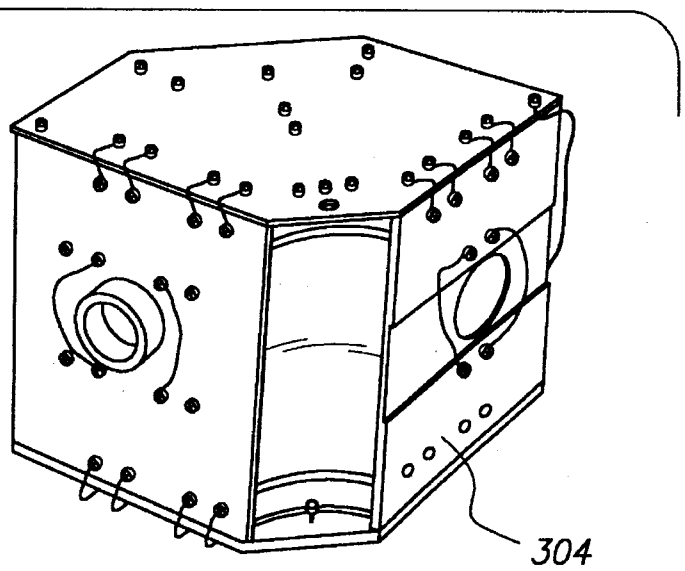
FIG. 3 is a perspective view of a spherical embodiment of one of the sectors which make up the analyzer of FIG. 1.

Referring next to FIG. 3, the sectors 24A–B may be better appreciated. The sectors 24A–B are comprised of a pair of sections 300 and 302 taken from a sphere and arranged concentrically. Alternatively, in at least some arrangements cylindrical or other toroidal sections may be used. Each pair of sections 300 and 302 is then placed within a sector housing 304. In most instances, the sections 300 and 302 are comprised of aluminum, although any suitable conductive material will do. In addition, the opposing surfaces of the sections are typically coated either with graphite or gold. Because the sectors 24 are symmetrical, each sector 24 can be used as either sector 24A or 24B in FIG. 1, simply by inverting the housing.

Figure 4:
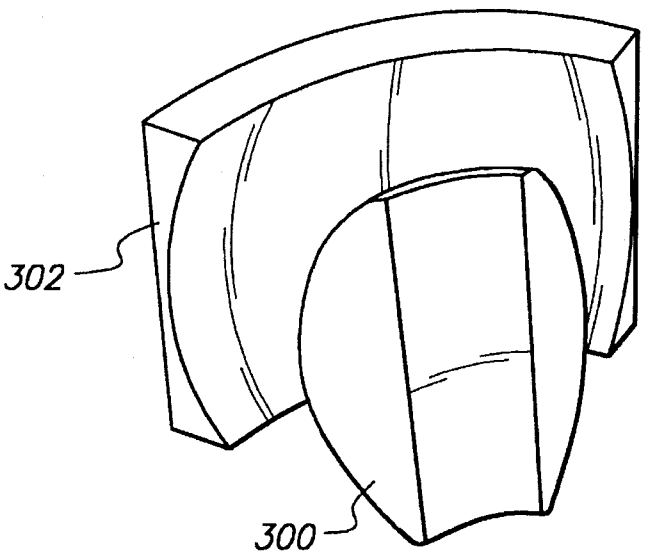
FIG. 4 is a schematic showing the terminator resistors.
Figure 4:
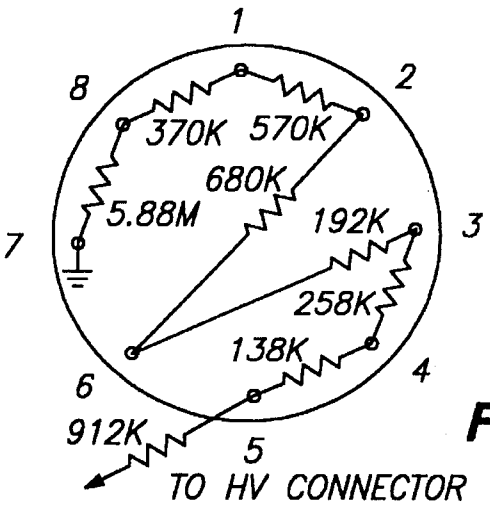

A voltage is applied between the two electrodes of the first sector, the more curved electrode being positive for a beam of negatively charged particles such as ions. The aperture electrode is maintained at the mean potential between the two electrodes. Equal potentials are applied to the electrodes of the second sector. With reference to FIG. 4, the high voltage feed through portion of the can be seen in schematic form. Any suitable conventional power source may be used.

Having fully described one embodiment of the present invention, it will be apparent to those of ordinary skill in the art that numerous alternatives and equivalents exist which do not depart from the invention set forth above. It is therefore to be understood that the invention is not to be limited by the foregoing description, but only by the appended claims.

What is claimed is:

1. An energy analyzer for separation of a collimated stream of electrons while preserving the spatial relationship between the electrons, comprising:

inlet means for receiving the stream of electrons to be analyzed;

a first arcuate energy analyzer means in communication with the inlet means for receiving, focusing and dispersing the collimated stream of electrons;

a second arcuate, complementary and opposed energy analyzer means abutting the first energy analyzer means for receiving the electron stream from the first energy analyzer means and canceling the dispersive effects of the first energy analyzer means to restore the same spatial relationship between the electrons in the electron stream as existed at the inlet means; and outlet means for receiving the electron stream from the second energy analyzer means to provide an exit image in which the electrons have substantially the same spatial relationship to each other as in the stream received at the inlet means.

2. The energy analyzer of claim 1 further including a selectable aperture means disposed at an exit end of the first energy analyzer means for selecting and passing desired paths of the stream of electrons into the abutting second energy analyzer means.

3. The energy analyzer of claim 1 wherein the outlet means includes a detection means for providing the exit image.

4. An electron analyzer for separation of a collimated stream of charged electrons having different kinetic energies, comprising:

an electron inlet means for receiving the collimated stream;

a first arcuate electron analyzer means for dispersing, focusing and separating the collimated stream of charged electrons dependent upon the kinetic energies of the charged electrons;

a complementary arcuate abutting but opposing electron analyzer means for canceling the dispersion in the collimated stream produced by the first electron analyzer means; and an outlet means for the collimated stream from the complementary analyzer means for passage of isolated charged electrons to a detection means for evaluation.

5. The electron analyzer of claim 4 wherein the first and the complementary electron analyzer means are opposed generally 90 to 120 degree sectors.

6. The electron analyzer of claim 4 further comprising at least one aperture means disposed between the first and complementary electron analyzer means for isolating and passing desired paths of the charged electrons into the complementary electron analyzer means.

7. The analyzer of claim 6 wherein the aperture means further has at least one slit.

8. The analyzer of claim 6 wherein the aperture means further has a plurality of interchangeable apertures disposed between the first and complementary electron analyzer means for isolating and passing desired paths of the charged electrons into the complementary electron analyzer means.

9. A charged particle analyzer for selecting certain energies from a collimated stream of charged particles while preserving the spatial relationship between the particles, comprising:

inlet means for receiving the stream of charged particles to be analyzed;

a first arcuate energy analyzer means in communication with the inlet means for receiving, focusing and dispersing the collimated stream of charged particles according to the energies of said particles to produce an image;

a second abutting arcuate, complementary and opposed energy analyzer means for receiving the charged particle stream from the first energy analyzer means and re-imaging by focusing and dispersing the charged particles, while preserving the same spatial relationship between the particles as in the stream received at the inlet means wherein the re-imaging is formed by cancelling the dispersive effects of the first energy analyzer means; and outlet means for receiving the charged particle stream from the second energy analyzer means to provide an exit image in which the particles have the same spatial relationship to each other as in the stream received at the inlet means.

10. The energy analyzer of claim 9 further including a selectable aperture means disposed between the first and second energy analyzer means for selecting and passing the charged particles of at least one desired energy from the dispersed stream into the second energy analyzer means.

11. The energy analyzer of claim 9 wherein the charged particles occupy a plurality of spatial positions within the collimated stream relative to their energies, said relative spatial positions maintained during passage of the collimated stream from the inlet means therethrough to the outlet means.

12. The analyzer of claim 9 wherein the charged particles are ions.

13. An electron analyzer for selecting at least one energy from a collimated stream of electrons having at least two energies, comprising:

inlet means for receiving the stream of electrons to be analyzed;

a first arcuate energy analyzer means in communication with the inlet means for receiving, focusing and dispersing the collimated stream of electrons according to their energies;

a second arcuate, complementary and opposed energy analyzer means for receiving the electron stream from the first energy analyzer means for re-focusing and re-dispersing the collimated stream, wherein the re-focusing and re-dispersing cancels the dispersive effects of the first energy analyzer means; and outlet means for receiving the electron stream from the second energy analyzer means to provide an exit image.

* * * * *